US008925230B2

(12) United States Patent
Warburton et al.

(10) Patent No.: US 8,925,230 B2
(45) Date of Patent: Jan. 6, 2015

(54) BOLT HANDLE ASSEMBLY FOR FIREARM

(71) Applicant: Sturm, Ruger & Company, Inc., Southport, CT (US)

(72) Inventors: Scott Warburton, South Acworth, NH (US); Bruce Rozum, Vernon, CT (US); Dwight Potter, Unity, NH (US)

(73) Assignee: Sturm, Ruger & Company, Inc.

( * ) Notice: Subject to any disclaimer, the term of this patent is extended or adjusted under 35 U.S.C. 154(b) by 94 days.

(21) Appl. No.: 13/715,420

(22) Filed: Dec. 14, 2012

(65) Prior Publication Data

US 2014/0013641 A1 Jan. 16, 2014

Related U.S. Application Data

(60) Provisional application No. 61/570,951, filed on Dec. 15, 2011.

(51) Int. Cl.

| | |
|---|---|
| ***F41A 3/12*** | (2006.01) |
| ***F41A 3/72*** | (2006.01) |
| ***F41A 3/14*** | (2006.01) |
| ***F41A 3/22*** | (2006.01) |

(52) U.S. Cl.

CPC ... *F41A 3/14* (2013.01); *F41A 3/72* (2013.01); *F41A 3/22* (2013.01)

USPC ..... 42/16; 89/1.4; 42/69.02

(58) Field of Classification Search

CPC ..... F41A 19/13; F41A 19/26; F41A 19/25; F41A 3/12; F41A 3/14; F41A 3/22; F41A 3/24; F41A 3/30; F41A 3/72

USPC ..... 42/16, 69.02; 89/1.4, 1.42, 11

See application file for complete search history.

(56) References Cited

U.S. PATENT DOCUMENTS 643,935 A * 2/1900 Bennett ..... 42/16
1,323,065 A * 11/1919 Johnoson ..... 42/16

(Continued)

FOREIGN PATENT DOCUMENTS

DE 3412010 10/1984
DE 3500025 7/1985

(Continued)

OTHER PUBLICATIONS

Corresponding International Search Report dated Feb. 19, 2013 (PCT/US2012/069827).

*Primary Examiner* — Bret Hayes
*Assistant Examiner* — Derrick Morgan
(74) *Attorney, Agent, or Firm* — The Belles Group, P.C.

(57) ABSTRACT

A bolt handle assembly for a firearm is disclosed. In one embodiment, the bolt handle assembly includes a bolt having an internal channel and a laterally extending slot, a bolt handle including a mounting tang insertable through the slot and having a locking aperture positioned in the internal channel, a firing pin striker slidably disposed in the internal channel, and a locking member mounted on the firing pin striker. The locking member is insertable through the locking aperture of the bolt handle and is configured for engaging the mounting tang of the bolt to removably secure the bolt handle to the bolt. The locking member is rotatable between locked and unlocked positions to secure and release the bolt handle from the bolt. A method for mounting the bolt handle to the bolt is also disclosed. In one embodiment, the firearm is a bolt-action rifle.

27 Claims, 11 Drawing Sheets

(56) References Cited

U.S. PATENT DOCUMENTS

| | | | | | |
|---|---|---|---|---|---|
| 1,324,493 | A | * | 12/1919 | Burton | 42/16 |
| 1,331,154 | A | * | 2/1920 | Johnson | 42/16 |
| 1,349,675 | A | * | 8/1920 | Johnson | 42/16 |
| 2,139,648 | A | * | 12/1938 | Chambers | 42/16 |
| 2,334,798 | A | * | 11/1943 | Swebilius | 42/17 |
| 3,005,279 | A | | 10/1961 | Brewer | |
| 3,404,480 | A | * | 10/1968 | Koucky et al. | 42/16 |
| 3,603,015 | A | | 9/1971 | Jensen | |
| 3,631,620 | A | * | 1/1972 | Ohira | 42/16 |
| 4,015,357 | A | * | 4/1977 | Andersson | 42/16 |
| 4,141,166 | A | | 2/1979 | Schultz | |
| 4,358,986 | A | | 11/1982 | Giorgio | |
| 4,454,672 | A | | 6/1984 | Timari | |
| 4,457,094 | A | | 7/1984 | Thompson | |
| 4,547,988 | A | | 10/1985 | Nilsson | |
| 4,569,145 | A | | 2/1986 | Ruger et al. | |
| 4,672,762 | A | | 6/1987 | Nilsson | |
| 4,681,020 | A | | 7/1987 | Polanecky | |
| 4,698,931 | A | * | 10/1987 | Larsson | 42/16 |
| 4,930,239 | A | | 6/1990 | Hunter | |
| 5,109,622 | A | * | 5/1992 | Echeberria | 42/69.02 |
| 5,440,963 | A | | 8/1995 | Szecsei | |
| 5,606,825 | A | * | 3/1997 | Olsen | 42/69.01 |
| 5,718,073 | A | | 2/1998 | Sachse et al. | |
| 5,722,194 | A | | 3/1998 | Wurger et al. | |
| 5,915,934 | A | * | 6/1999 | Knight et al. | 42/51 |
| 5,960,574 | A | | 10/1999 | Lameiras Guede | |
| 6,019,024 | A | | 2/2000 | Robinson et al. | |
| 6,209,249 | B1 | | 4/2001 | Borden | |
| 6,240,670 | B1 | * | 6/2001 | Findlay | 42/70.08 |
| 6,360,467 | B1 | * | 3/2002 | Knight | 42/51 |
| 6,401,378 | B1 | | 6/2002 | Ockenfuss | |
| 6,418,655 | B1 | | 7/2002 | Kay | |
| 6,508,025 | B1 | * | 1/2003 | Du Plessis | 42/16 |
| 6,820,533 | B2 | | 11/2004 | Schuerman | |
| 6,886,285 | B1 | | 5/2005 | Sirkis et al. | |
| 7,000,345 | B1 | * | 2/2006 | Kay | 42/75.02 |
| 7,392,611 | B2 | | 7/2008 | Curry | |
| 7,743,543 | B2 | * | 6/2010 | Karagias | 42/69.02 |
| 7,895,786 | B2 | | 3/2011 | Caulley | |
| 2004/0103777 | A1 | | 6/2004 | Moore | |
| 2005/0223613 | A1 | | 10/2005 | Bender | |
| 2009/0049730 | A1 | * | 2/2009 | Caulley | 42/69.02 |
| 2009/0101000 | A1 | * | 4/2009 | Rawson-Harris | 89/183 |
| 2010/0162605 | A1 | | 7/2010 | Laney et al. | |
| 2010/0175290 | A1 | | 7/2010 | Duplessis et al. | |
| 2010/0257768 | A1 | | 10/2010 | Barrett | |
| 2010/0281733 | A1 | | 11/2010 | Constant et al. | |
| 2010/0313459 | A1 | | 12/2010 | Gomez | |
| 2011/0030261 | A1 | | 2/2011 | Karagias | |
| 2011/0083551 | A1 | | 4/2011 | Sirochman | |
| 2012/0137556 | A1 | * | 6/2012 | Laney et al. | 42/6 |

FOREIGN PATENT DOCUMENTS

| | | |
|---|---|---|
| DE | 3610936 | 10/1986 |
| DE | 3720356 | 1/1988 |
| DE | 3742886 | 6/1988 |
| DE | 3743441 | 6/1988 |
| DE | 3816022 | 11/1988 |
| GB | 105425 | 4/1917 |
| GB | 126055 | 5/1919 |
| GB | 133080 | 10/1919 |
| GB | 873475 | 7/1961 |

* cited by examiner

FIG. 10A
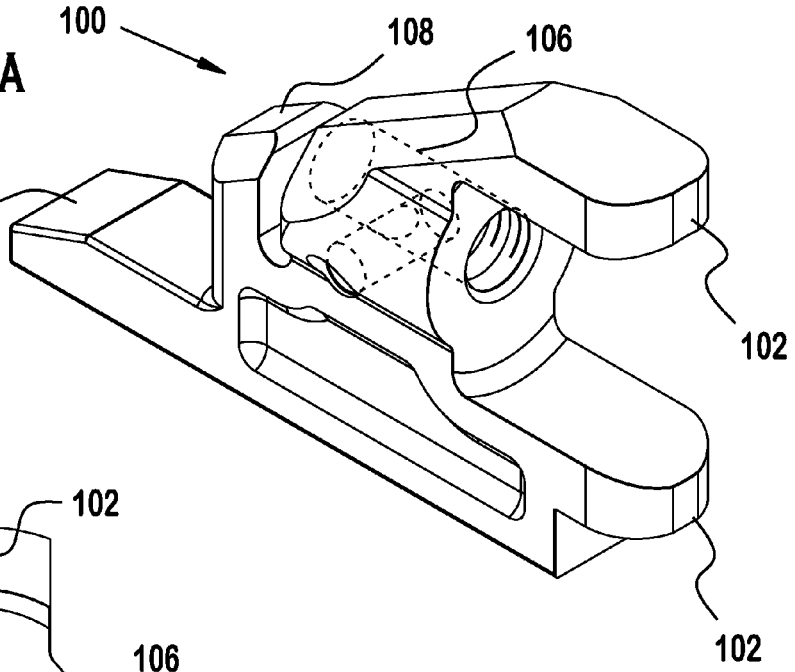
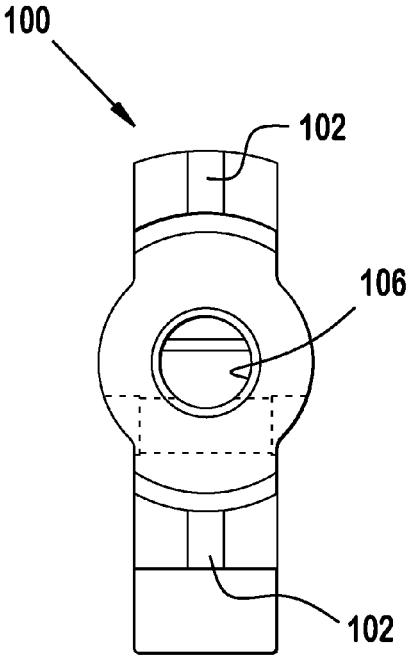
FIG. 10B
FIG. 10C
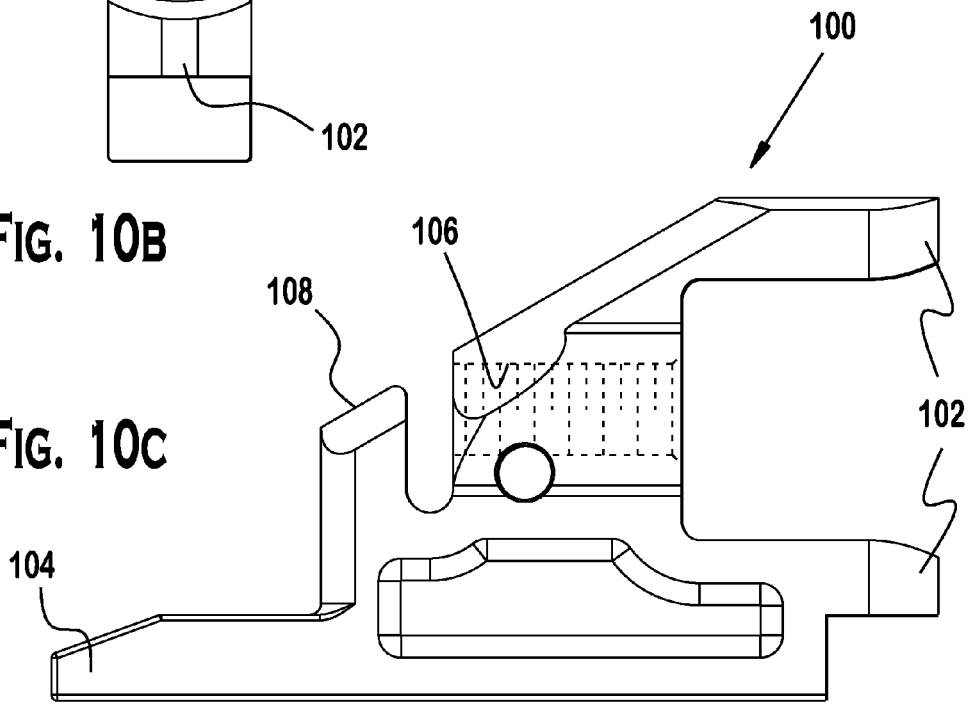

BOLT HANDLE ASSEMBLY FOR FIREARM

The present application claims the benefit of priority to U.S. Provisional Application No. 61/570,951 filed Dec. 15, 2011, which is incorporated herein by reference in its entirety.

BACKGROUND OF THE DISCLOSURE

The present disclosure generally relates to firearms, and more particularly to bolt handle assemblies for bolt action rifles.

Bolt action rifles generally include a barrel, receiver onto which the barrel is mounted, and a bolt assembly including a cylindrical breech bolt that is axially movable in a receiver for opening and closing the breech. The bolt includes locking lugs at the front end which may be rotatably locked into the rear of the barrel or front of the receiver adjacent the chamber to form a closed locked breech. The bolt may be manually rotated between the locked and unlocked positions while in the closed breech position and also moved axially forward or rearward via a handle that protrudes laterally outwards from the bolt for grasping by a user. The bolt is moved rearward for opening the breech to unload and eject spent cartridge casings from the chamber in the rear of the barrel. A new cartridge may then be inserted manually into the chamber or uploaded automatically from a magazine which is then fed into the chamber by moving the bolt forward to close the breech in preparation for firing the next round.

Bolt handles may sometimes be formed as an integral part of the unitary bolt structure or as a separate part that is mechanically attached to the bolt via a threaded connection or a welded, soldered, or brazed joint. In the former case, the fabrication and machining costs are higher than desired due to the complex configuration of the longitudinally-extending bolt with laterally projecting curved handle, which are both formed from a monolithic piece of metal. In the latter case, threads must be machined on both the handle and bolt socket which similarly increases fabrication costs. In addition, the handle may loosen during use due to the threaded connection or separate at the brazed junction.

An improved bolt handle assembly is desired for a rifle.

SUMMARY OF THE DISCLOSURE

A bolt assembly and method for assembling a bolt handle to the bolt is provided. In one exemplary embodiment, the bolt assembly generally includes a bolt handle having a locking aperture and a locking member disposed on the firing pin striker that is engageable with the handle through the aperture. The locking member may be T-shaped in some possible embodiments without limitation and rotatable between unlocked and locked positions. In some embodiments, the locking member may be disposed on a cocking piece attached to the striker. In other embodiments, the locking member and cocking piece may be separate components mounted on the striker.

In one exemplary embodiment, a bolt handle assembly for a rifle includes a bolt having an elongated body defining a longitudinal axis, an internal channel extending between forward and rear ends of the bolt, and a laterally extending slot, a bolt handle including a mounting tang removably inserted through the slot in the bolt and having a locking aperture positioned in the internal channel of the bolt, a firing pin striker slidably disposed in the internal channel of the bolt, and a locking member mounted on the firing pin striker. The locking member has a portion with front end configured and dimensioned for axial insertion through the locking aperture of the bolt handle. The locking member is rotatable and operable to engage the mounting tang of the bolt to releasably secure the bolt handle to the bolt. The locking member is rotatable between a locked position in which the front end of the locking member engages the mounting tang of the bolt handle and the locking member cannot be moved axially in the bolt, and an unlocked position in which the front end of the locking member disengages the mounting tang of the bolt handle and the locking member can be moved axially in the bolt.

In another exemplary embodiment, a bolt handle assembly for a rifle includes a bolt having an elongated body defining a longitudinal axis, an internal channel extending between forward and rear ends of the bolt, and a laterally extending slot, a bolt handle including a mounting tang removably inserted through the slot in the bolt and having a locking aperture positioned in the internal channel of the bolt, the bolt handle having a front side and a rear side, a firing pin striker slidably disposed in the internal channel of the bolt, and a locking member having a generally cylindrical body configured and dimensioned for at least partial insertion into the internal channel of the bolt. The locking member is rotatably disposed in the internal channel of the bolt and includes a locking member including a locking flange engageable with the mounting tang of the bolt handle and being configured for longitudinal axial insertion through the locking aperture of the bolt handle. The locking flange locks the bolt handle to the bolt when the locking member is in a first locked rotational position. The locking flange unlocks the bolt handle from the bolt for removal when the locking member is in a second unlocked rotational position.

In another exemplary embodiment, a bolt handle assembly for a rifle includes a bolt having an elongated body defining a longitudinal axis, an internal channel extending between forward and rear ends of the bolt, and a laterally extending slot, a bolt handle including a mounting tang removably inserted through the slot in the bolt and having a locking aperture positioned in the internal channel of the bolt, the mounting tang having a front side and a rear side, a firing pin striker slidably disposed in the internal channel of the bolt, and a locking member rotatably disposed in the internal channel of the bolt and mounted on the firing pin striker. The locking member includes at least one rear facing abutment surface rotatable into and out of engagement with a forward facing seat on the front side of the mounting tang of the bolt handle. The at least one rear facing abutment surface is operable to lock the bolt handle to the bolt.

An exemplary method for mounting a bolt handle to a bolt action rifle is provided. In one embodiment, the method includes: providing a bolt having an elongated body defining a longitudinal axis, an internal channel extending between forward and rear ends of the bolt configured for receiving a firing pin striker, and a laterally extending slot; laterally inserting a mounting tang of a bolt handle having a locking aperture through the slot in the bolt; axially inserting an end of a locking member through the locking aperture in a first longitudinal direction; rotating the locking member in a first direction; and engaging the end of the locking member with the mounting tang of the bolt handle, wherein the bolt handle cannot be removed from the bolt. In the foregoing and other embodiments, the method further includes rotating the locking member in a second direction; disengaging the end of the locking member with the mounting tang of the bolt handle; and axially withdrawing the end of a locking member through the locking aperture in a second longitudinal direction, wherein the bolt handle can be removed from the bolt. In the foregoing and other embodiments, the locking member is rotated 90 degrees in the first direction and the second direction.

BRIEF DESCRIPTION OF THE DRAWINGS

The features of the exemplary embodiments will be described with reference to the following drawings where like elements are labeled similarly, and in which:

FIG. 10A shows a front perspective view of the cocking piece in the bolt handle assembly of FIG. 1;

FIG. 10B shows a front end (right end) view thereof;

FIG. 10C shows a side elevation view thereof;

Any reference herein to a single figure (e.g. FIG. 9) including multiple subpart figures (e.g. FIGS. 9A, 9B, etc.) shall be construed as a reference to all subpart figures in that group unless specifically noted otherwise.

DESCRIPTION OF EXEMPLARY EMBODIMENTS

Figure 1:
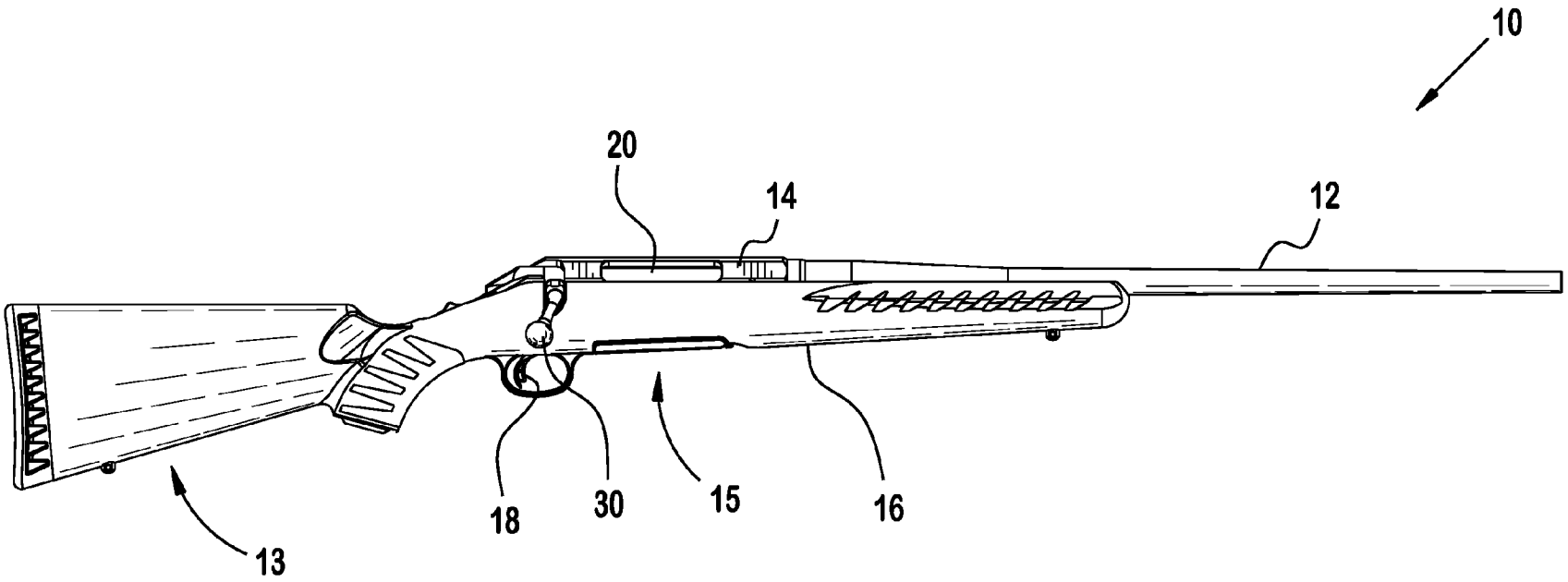
FIG. 1 shows a side elevation view of one embodiment of a bolt action rifle with bolt handle assembly according to the present disclosure.

The features and benefits of the invention are illustrated and described herein by reference to exemplary, embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

An exemplary embodiment will now be described for convenience with reference and without limitation to bolt action rifle 10 shown in FIG. 1. Rifle 10 includes a conventional receiver 14 and a barrel 12 mounted thereto having a chamber at the rearward end for holding a cartridge. Receiver 14 is fixedly mounted in a stock 16 which includes a rear butt stock portion 13 and a forward portion 15 configured for mounting the receiver thereto.

Figure 2:
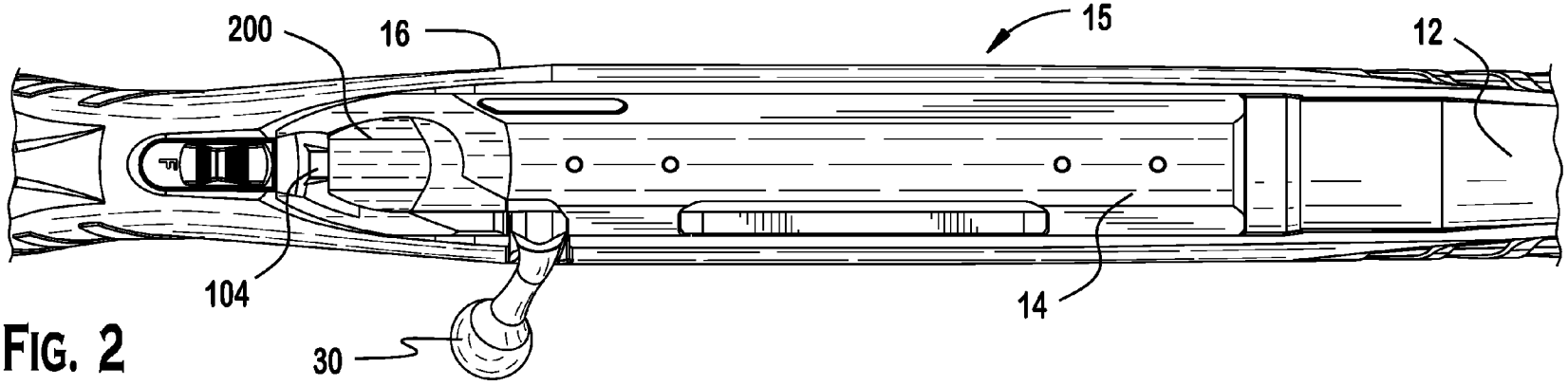
FIG. 2 shows a top plan view of the receiver portion of the rifle and bolt handle assembly of FIG. 1 with the bolt in a forward locked position in battery with the chamber.
Figure 3:
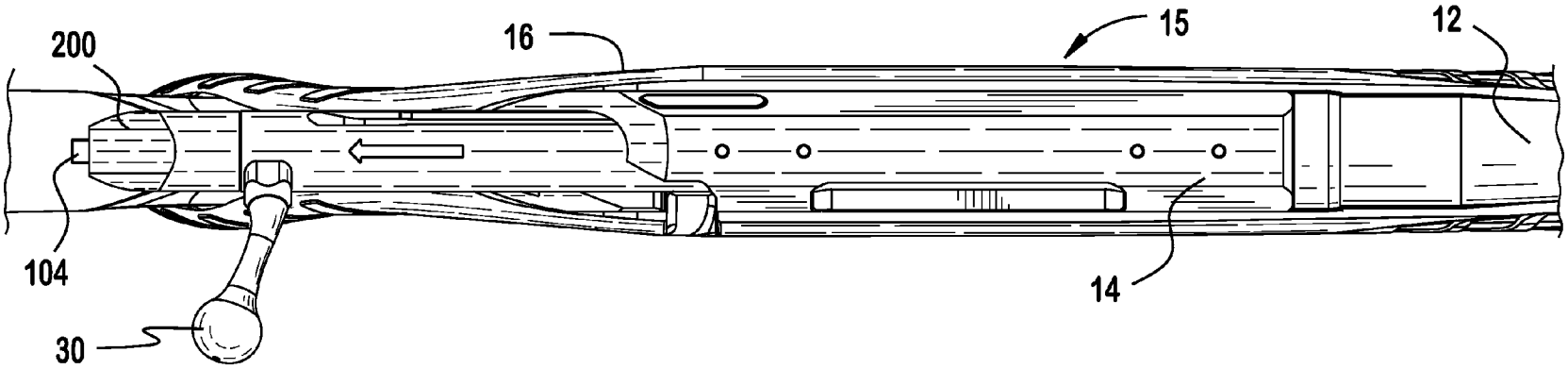
FIG. 3 shows a top plan view of the receiver portion of the rifle and bolt handle assembly of FIG. 1 with the bolt in a rearward and retracted position.

FIGS. 2 and 3 show a close-up view of the receiver portion of rifle 10. Referring to FIGS. 1-3, rifle 10 has a conventional bolt action rifle firing mechanism including a trigger-sear assembly 18 and spring-loaded firing pin striker 50 (alternatively "firing pin") that is slidably disposed in a retractable breech bolt 20 for axial movement therein. The trigger-sear assembly 18 is operable to release and project striker 50 forward by a distance wherein a front end 54 of the striker contacts and detonates a chambered cartridge to discharge the rifle. Conventional bolt action rifle firing mechanisms, trigger assemblies, and their operation for engaging and releasing a firing pin striker are described in U.S. Pat. Nos. 4,672,762 and 4,569,145, which are incorporated herein by reference in their entirety.

Figure 4:
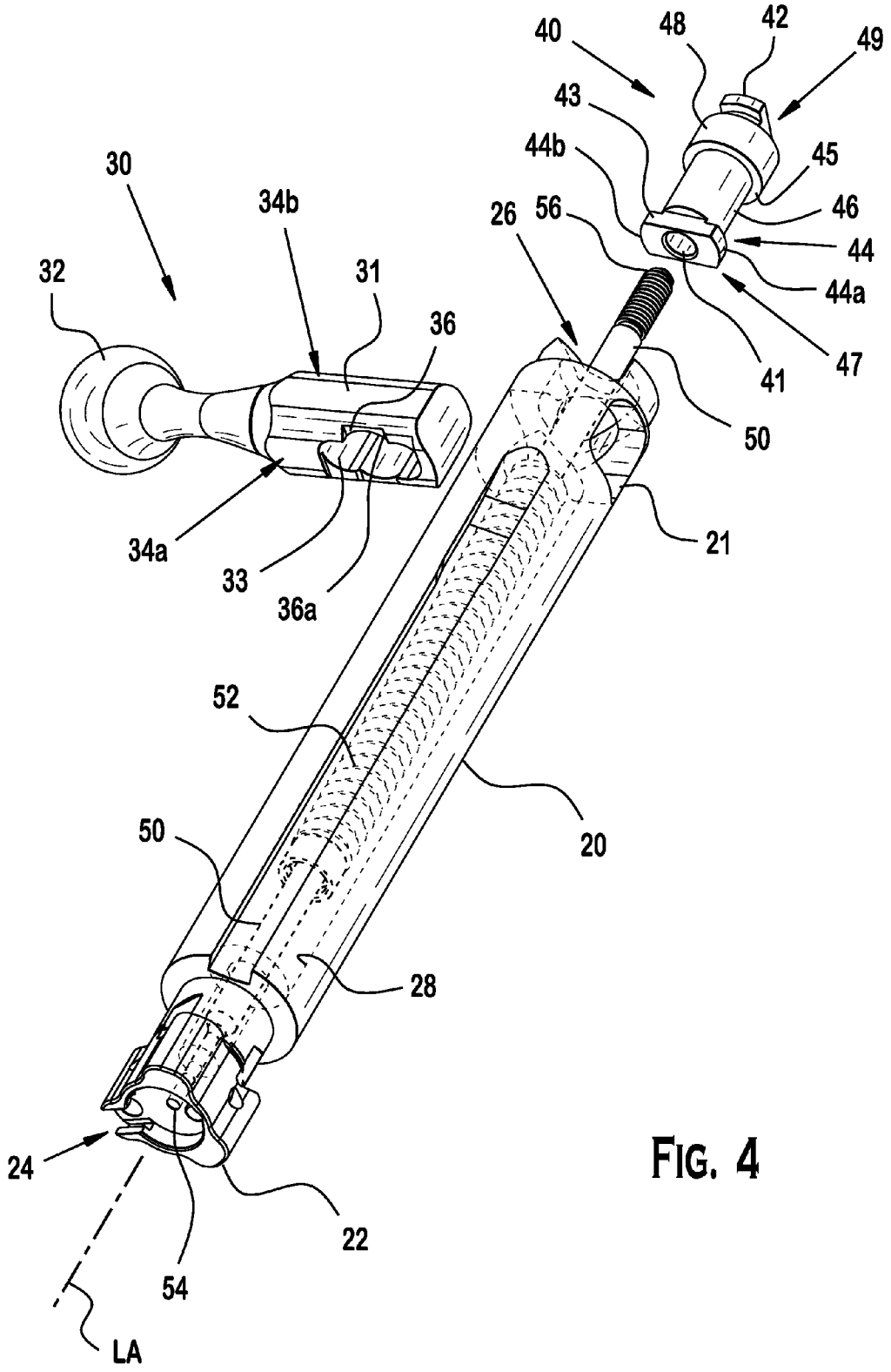
FIG. 4 shows an exploded disassembled view of the bolt handle assembly.
Figure 5:
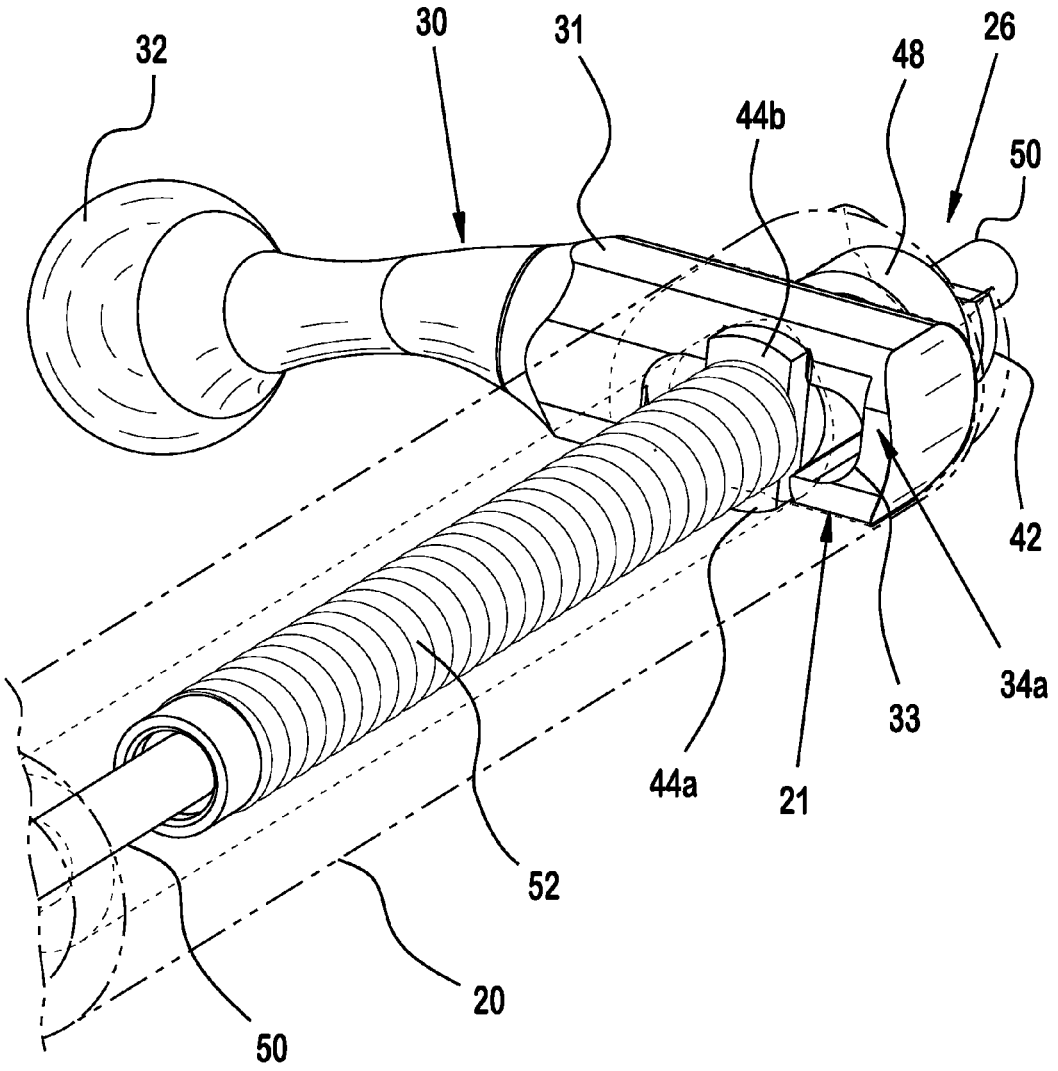
FIG. 5 shows a close-up assembled view of the bolt handle assembly with the bolt handle mounted in the bolt.

With additional reference to FIGS. 4 and 5, bolt 20 is generally elongated and cylindrical in shape in typical fashion. The bolt 20 includes conventional bolt locking lugs 22 at a forward end 24 and an open rear end 26 leading to a generally cylindrical internal channel 28 that extends axially inside the bolt to movably receive firing pin striker 50 and spring 52 therein. In one embodiment, channel 28 extends axially completely through bolt 20 from rear end 26 to forward end 24 so that both the ends are preferably open. The front end 54 of striker 50 may be projected forward from the channel through forward end 24 within bolt locking lugs 22 towards a chambered cartridge. Rear end 26 is open to permit insertion of striker 50, spring 52, and a locking member 40. Bolt locking lugs 22 are engageable with mating lugs or surfaces inside receiver 14 for closing and locking the breech in preparation for discharging the rifle 10.

Referring to FIGS. 2 and 3, bolt 20 is axially movable in receiver 14 between two operating positions including a forward axial firing position (FIG. 2) in which the breech is closed for discharging rifle 10, and a rearward axial position (FIG. 3) in which the breech is open for ejecting spent cartridge casings from the rifle and loading new cartridges into the chamber either manually or from a magazine. Bolt 20 is further rotatable within receiver 14 with respect to a longitudinal axis LA defined by the barrel 12 between a locked rotational firing position in bolt locking lugs are engaged with the receiver and the breech is closed, and an unlocked rotational ejecting/loading position which the locking lugs are not engaged with the receiver. In a conventional operating manner in one embodiment, the bolt 20 is moveable between the forward and rearward axial positions when the bolt is in the unlocked rotational position. In one embodiment, rifle 10 may be a manually operated rifle wherein bolt 20 is manually moved between the forward and rearward axial positions and locked and unlocked rotational positions by hand.

Figure 6:
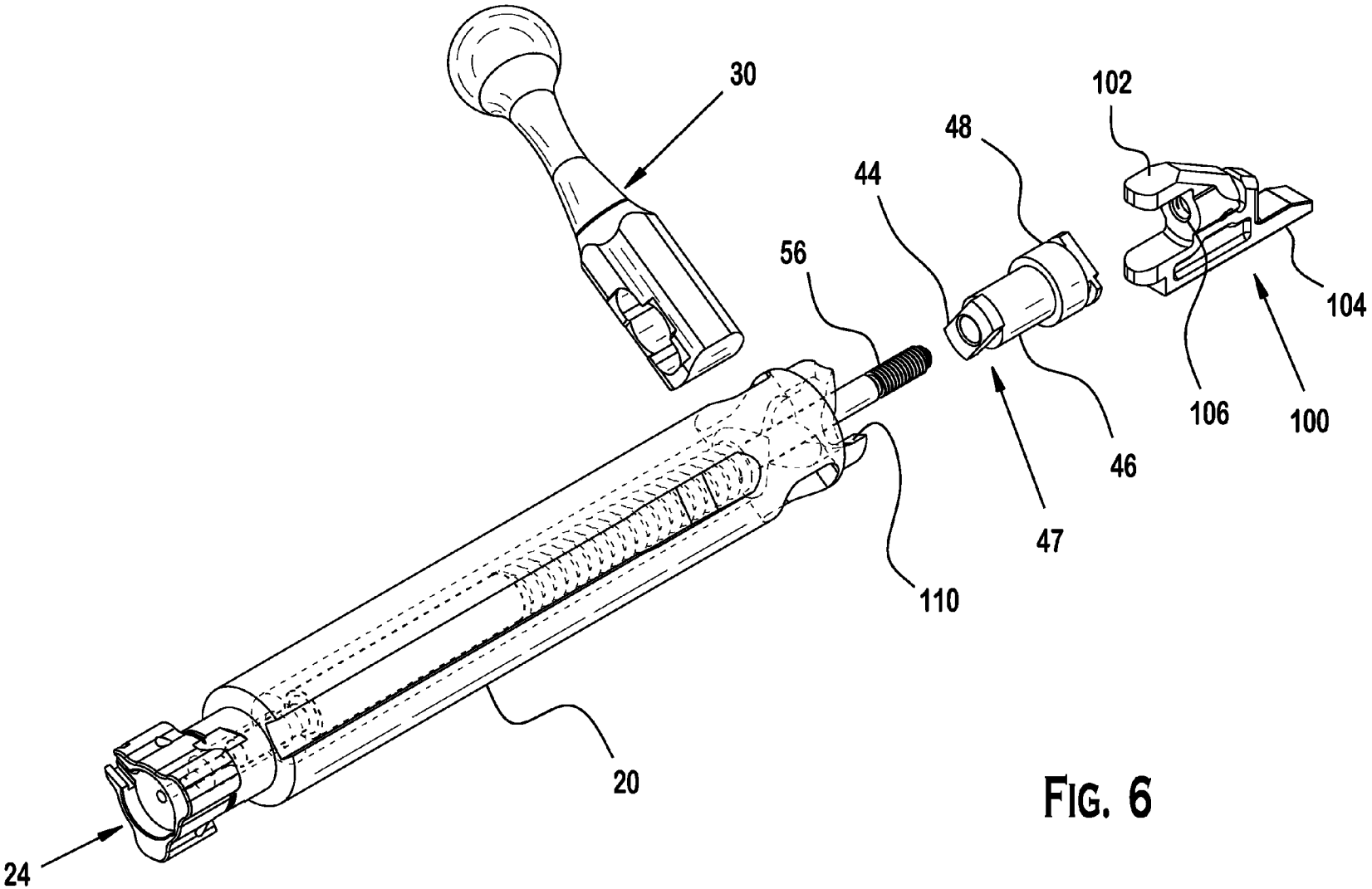
FIG. 6 shows an exploded disassembled view of an alternative embodiment of a bolt handle assembly useable in the rifle of FIG. 1.
Figure 7:
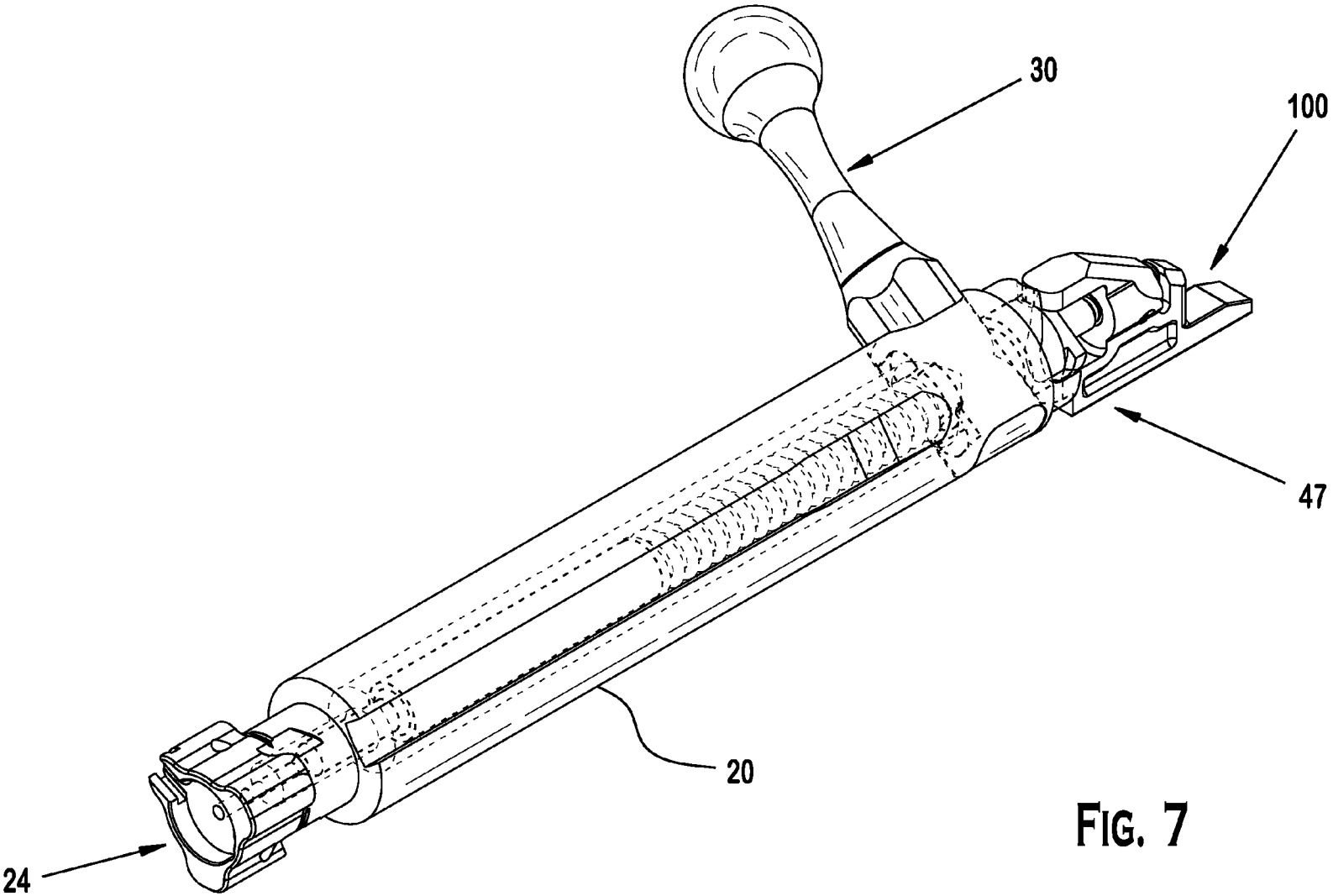
FIG. 7 shows an assembled view of the bolt handle assembly of FIG. 6 with the bolt handle mounted in the bolt.
Figure 8:
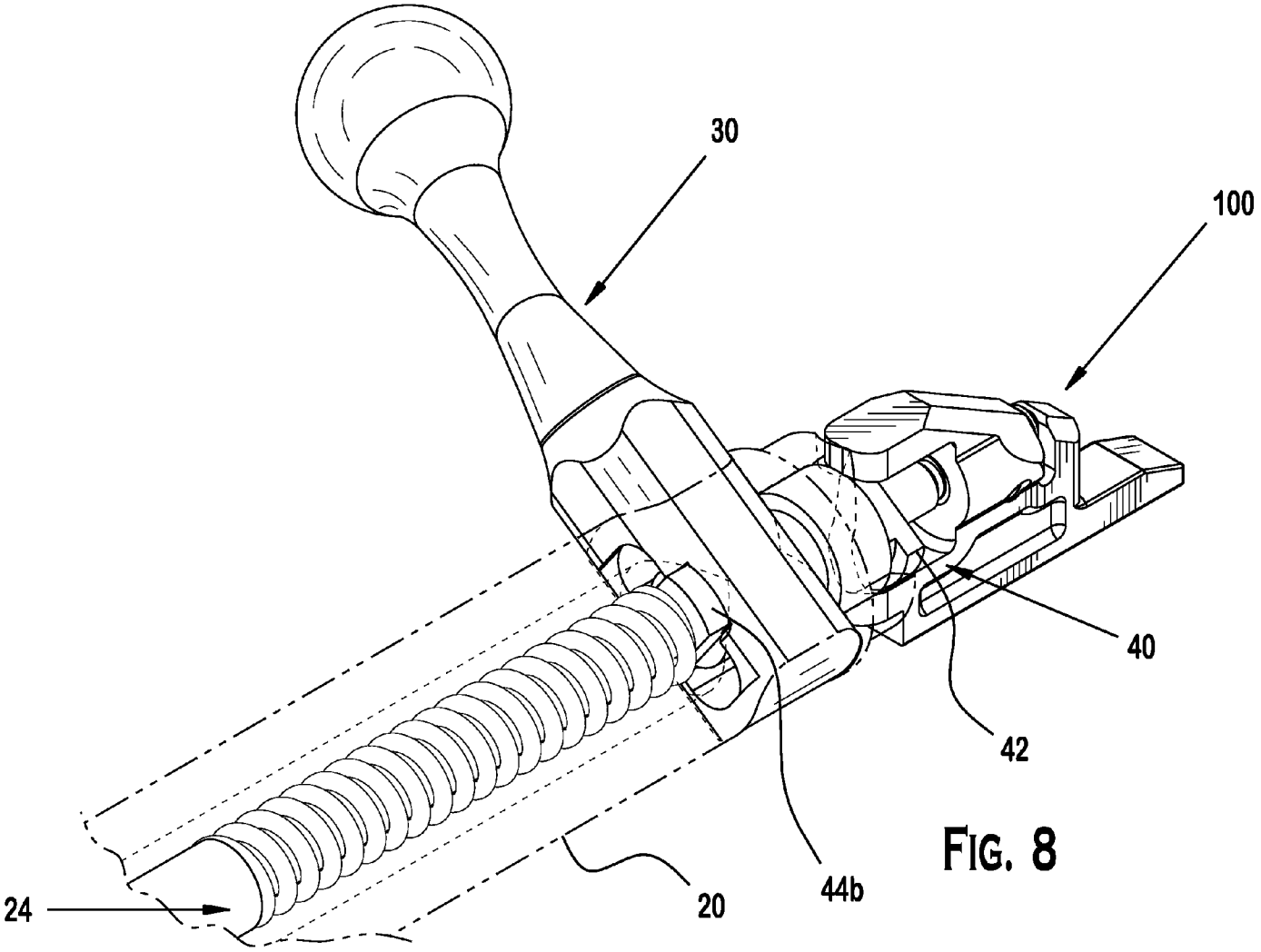
FIG. 8 shows a close-up assembled view of the bolt handle assembly of FIG. 6 with the bolt handle mounted in the bolt.
Figure 9A:
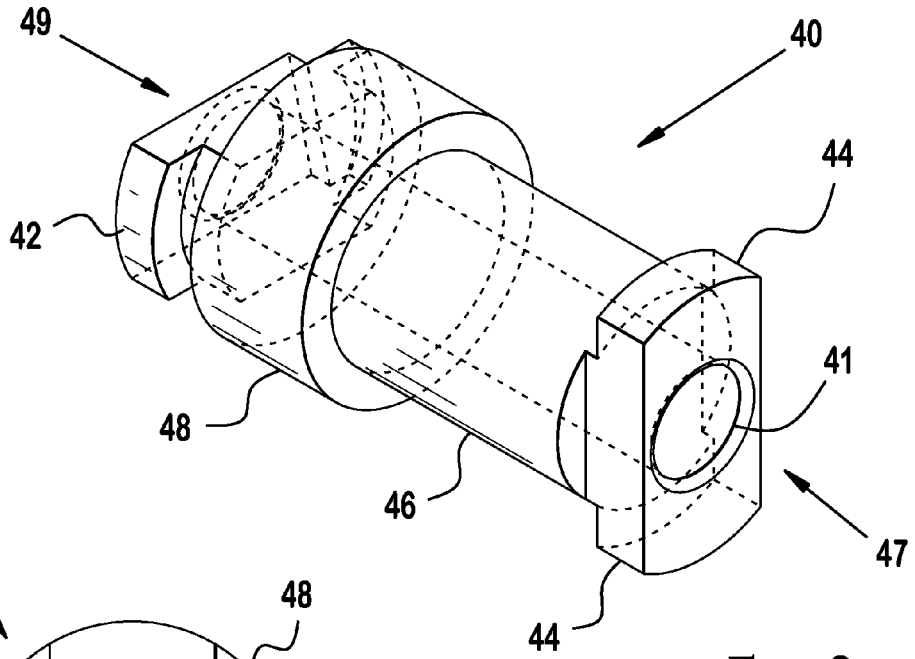
FIG. 9A shows a front perspective view of the locking member in the bolt handle assembly of FIG. 1 with locking flanges in a locked orientation.
Figure 9C:
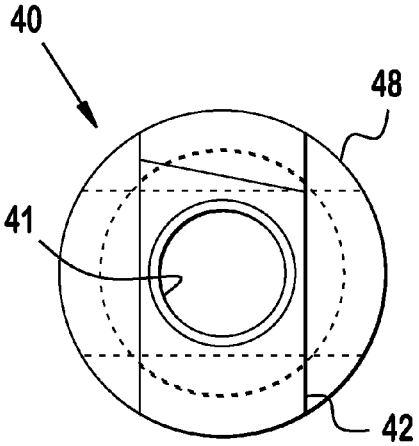
FIG. 9C shows a rear end (left end) view thereof.
Figure 9B:
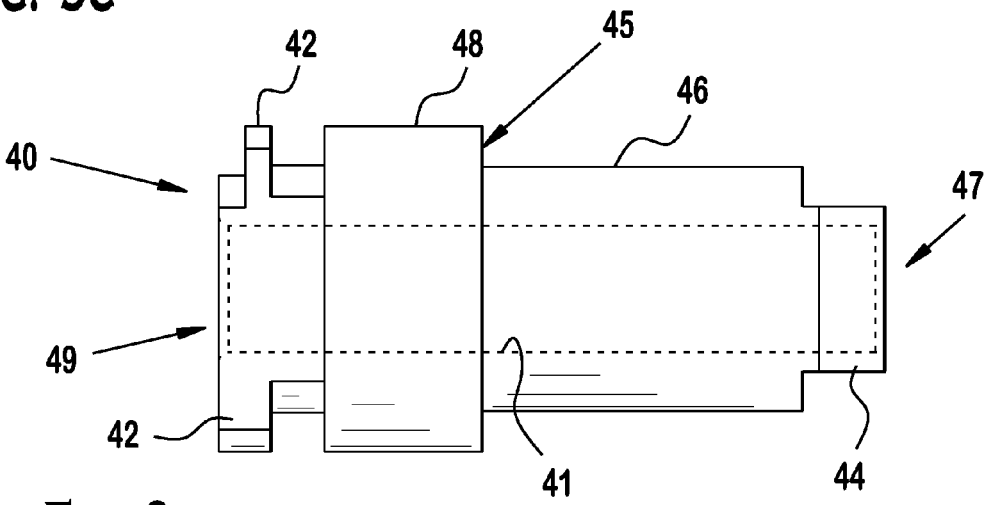
FIG. 9B shows a top plan view thereof.
Figure 9D:
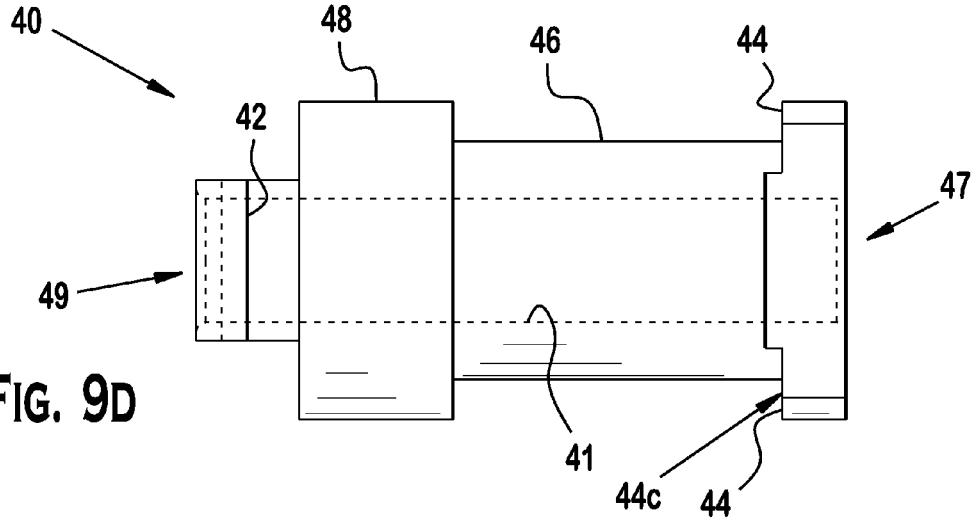
FIG. 9D shows a side elevation view thereof.
Figure 9F:
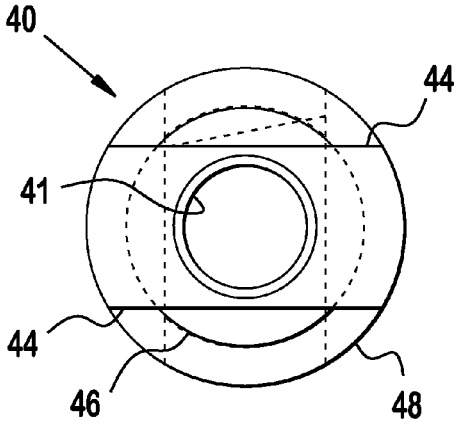
FIG. 9F shows a front end (right end) view thereof.
Figure 9E:
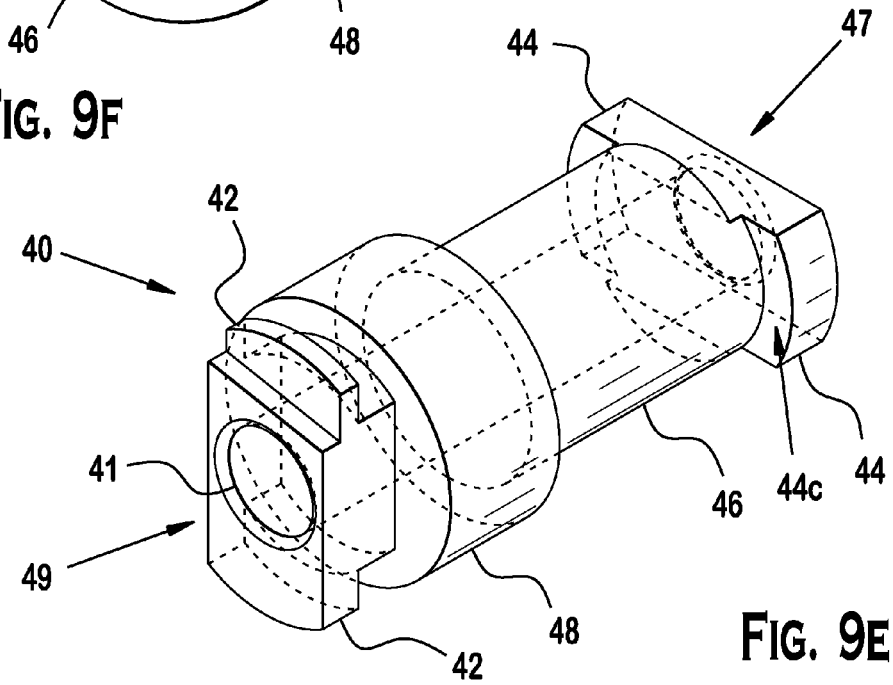
FIG. 9E shows a rear perspective view of the locking member with locking flanges in an unlocked orientation.
Figure 10E:
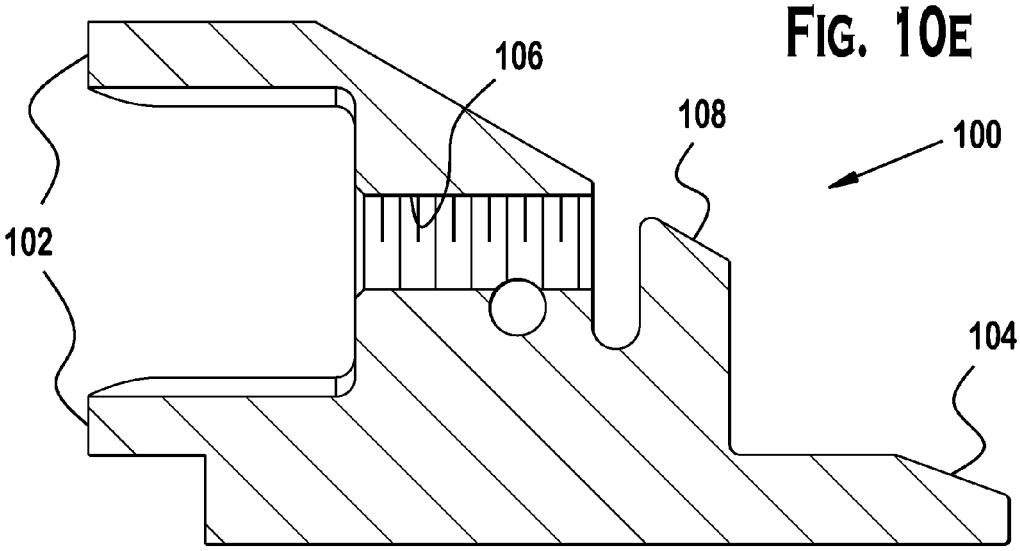
FIG. 10E shows a side elevation cross-sectional view thereof.
Figure 10D:
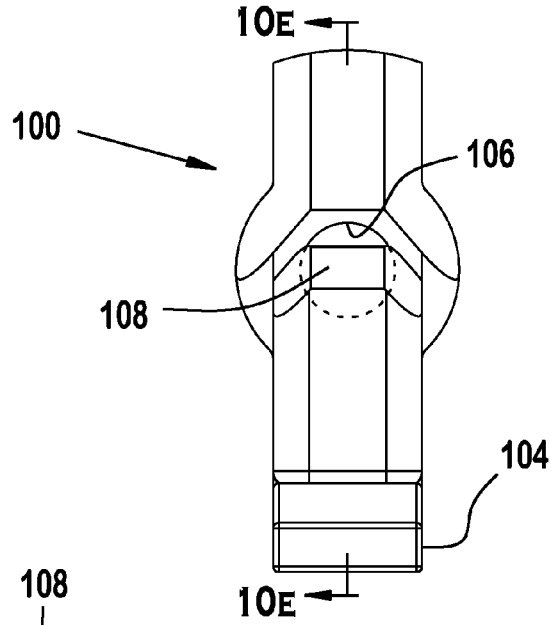
FIG. 10D shows a rear end (left end) view thereof.
Figure 10F:
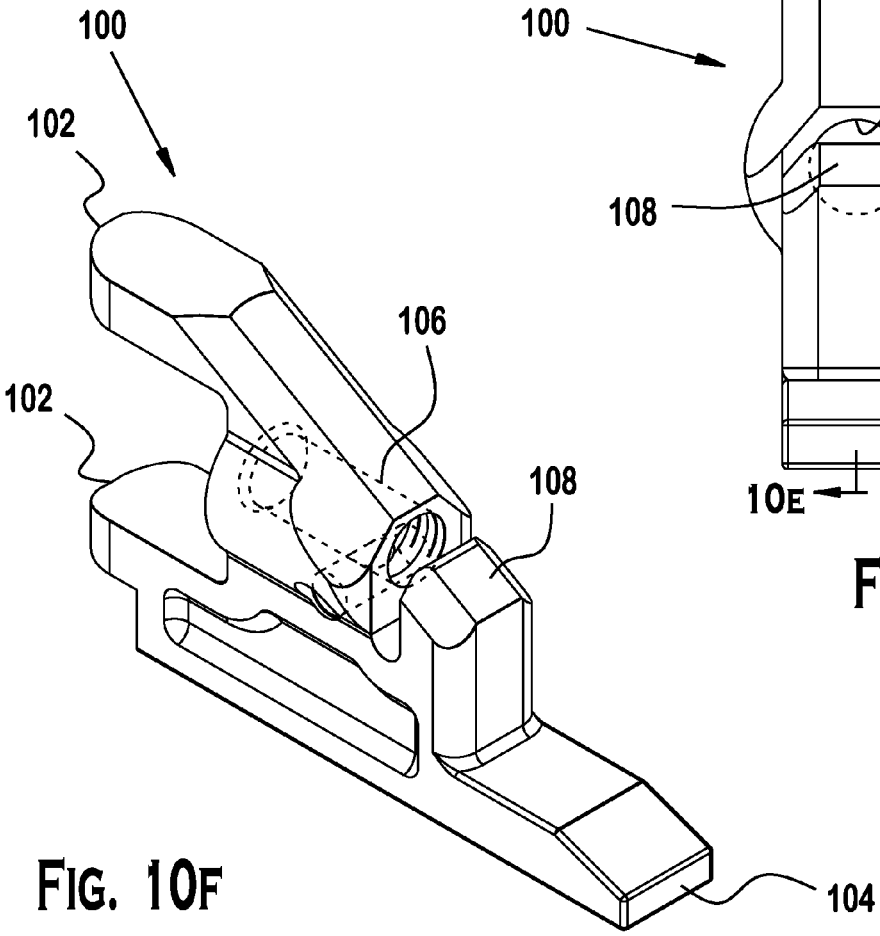
FIG. 10F shows a rear perspective view of the cocking piece.

Referring to FIGS. 4-8, locking member 40 may be attached proximate to the rear end 56 of the firing pin striker 50 or spaced slightly forward of the rear end to accommodate mounting cocking piece 100 (see FIGS. 6-8). Locking member 40 engages and secures bolt handle 30 to bolt 20. In one embodiment, the locking member 40 may be disposed forward of a cocking piece 100 attached to the striker 50 (see, e.g. FIGS. 6-8). In some embodiments, without limitation, the locking member 40 may be T-shaped and rotatable between unlocked and locked rotational positions as further described herein.

In one embodiment, with additional reference to FIGS. 9A-F, locking member 40 may have a generally cylindrical body which is configured and dimensioned for at least partial insertion into channel 28 of bolt 20 through rear end 26 as shown in FIGS. 4 and 5. In this embodiment, locking member 40 may include a T-shaped front end 47 formed by a radially projecting locking flange 44 for securing the bolt handle 30 to bolt 20. Locking member 40 further includes a radially projecting pair of rear flanges 42 disposed on a rear end 49. Rear flanges 42 cooperate with the cocking piece 100 and camming notches 110 formed on the rear of bolt 20 (see also FIGS. 6-8). In some embodiments, rear flanges 42 may further cooperate with and rotatably engage complementary configured and transversely oriented keyways formed inside a removable cap-like bolt shroud 200 (shown in FIGS. 2 and 3) that serves to encloses the bolt assembly from the rear. The rear flanges 42 ensure that the bolt shroud 200 remains affixed to and moves axially together with the bolt assembly between its forward and rearward positions on rifle 10. The bolt shroud 200 is removable from locking member 40 by rotating the shroud with respect to the locking member wherein the flanges 42 leave their mating keyways thereby permitting the shroud to be axially removed for access to the locking member, other bolt handle components, and rear end of the bolt 20.

With continuing reference to FIGS. 4, 5, and 9, locking flange 44 in some embodiments may extend laterally outwards from locking member 40 in two diametrically opposed radial directions as shown, for reasons which will become apparent. Accordingly locking flange 44 may have a symmetrical shape with respect to the longitudinal axis of locking member 40 in some embodiments. Locking flange 44 defines a first ear 44*a* on one side and an opposing second ear 44*b* on the remaining second side (see FIG. 4). Ears 44*a*, 44*b* are rotatably engageable with bolt handle 30, as further described herein.

It will be appreciated that although locking flange 44 may be generally T-shaped with two ears 44*a*, 44*b* as shown in FIGS. 4 and 5 in some embodiments for added security in locking bolt handle 30 to bolt 20. Other embodiments contemplated may include only a single ear 44*a* or 44*b* giving locking member an asymmetrical shape. Accordingly, some exemplary embodiments may include a locking member 40 with a locking flange 44 preferably having at least one ear 44*a* or 44*b* projecting radially outwards in one lateral direction.

Disposed between the ends of locking member 40 in one embodiment is a cylindrical intermediate portion 46 adjacent locking flange 44 and a diametrically enlarged cylindrical boss portion 48 adjacent the rear flange 42, as shown in FIGS. 4, 5, and 9. In some embodiments, locking flange 44 extends laterally outwards beyond intermediate portion 46 from both sides of portion 46 as shown. Boss portion 48 preferably has a larger diameter than intermediate portion 46 as shown, thereby forming a step and forward facing abutment surface 45 on boss portion that engages rear side 34*b* of bolt handle mounting tang 31 which limits the insertion depth of locking member 40 through locking aperture 33. When locking member 40 is full seated in mounting tang 31 of bolt handle 30, the tang will be trapped between boss portion 48 and locking flange 44 of the locking member to secure the handle in bolt 20.

The forward end 47 of locking member 40 may include a socket 41 configured and dimensioned for receiving the rear end 56 of striker 50 therethrough. In some embodiments, socket 41 may extend completely through locking member 40 to form a through passage as shown in FIGS. 9A-D allowing rear end 56 of the firing pin striker 50 to pass completely through locking member 40 and engage cocking piece 100 (see FIGS. 6-8). Locking member 40 may be freely rotatable on striker 50 without engagement in some embodiments to allow the striker to be cocked rearward and released forward to strike a chambered round while locking member 40 remains engaged with and fixed in position with respect to bolt handle 30.

Bolt handle 30 preferably is provided as a separate component that is attachable to bolt 20. Referring to FIGS. 4 and 5, bolt handle 30 includes a preferably bulbous grasping portion 32 on one end and an mounting tang 31 on an opposite end for attachment to bolt 20. Grasping portion 32 may have any suitable shape and configuration other than bulbous. In some embodiments, mounting tang 31 may be slab-sided and have a generally rectangular overall outer configuration and corresponding transverse cross-sectional shape (when viewed perpendicular to the longitudinal axis LA). Mounting tang 31 is preferably laterally elongated a shown in FIGS. 4-6. The free end 35 of mounting tang 31 may be slightly arcuately rounded or otherwise shaped in some embodiments to conform to the circumferential side profile of the bolt 20 through which the tang is inserted and positioned (see, e.g. FIG. 5) so as to not interfere with sliding of the bolt in the complementary configured portion of the receiver 14. In one embodiment, as shown in FIG. 8, end 35 of mounting tang 31 may be exposed through the sidewall of bolt 20 when the bolt handle 30 is mounted to the bolt.

Referring to FIGS. 4 and 5, mounting tang 31 is configured and dimensioned for insertion into laterally extending handle-receiving slot 21 formed proximate to the rear end 26 of bolt 20. Slot 21 is oriented perpendicular to longitudinal axis LA and intersects the axially extending channel 28 inside bolt 20. Preferably, slot 21 is complementary configured in cross-sectional shape with the cross-sectional shape of handle mounting tang 31 to provide a relatively snug fit when the handle is inserted therein without excessive looseness.

With continuing reference to FIGS. 4 and 5, mounting tang 31 preferably includes an axially aligned locking aperture 33 (parallel to longitudinal axis LA) for receiving at least part of locking member 40 therethrough. Aperture 33 preferably extends completely through the front and rear sides 34*a* and 34*b* of the tang as shown. Aperture 33 is laterally elongated having a greater width than height, and sized to allow locking flange 44 of locking member 40 to be completely inserted therethrough so that the locking flange emerges from the front side of handle mounting tang 31 as shown in FIGS. 5 and 8. In one embodiment, locking flange 44 has a greater width than height as shown in FIGS. 4 and 9A-D to complement the similar configuration of locking aperture 33 in bolt handle 30, for reasons which will become apparent as further described herein.

Adjacent above and below elongated aperture 33 in some preferred embodiments may be flat recessed seats 36 formed on front side 34*a* of mounting tang 31 which define seating surfaces for holding locking flange 44 of locking member 40 in position (see FIGS. 4 and 5). These forward facing seats 36 are engageable with rear facing abutment surfaces 44*c* (see FIGS. 9A-D) on ears 44*a*, 44*b* of locking flange 44 when the locking member 40 is in the locked position as shown in FIGS. 5 and 7-8. The flat vertical sidewalls 36*a* defined by recesses or recessed seats 36 (see FIG. 4) are engageable with the side flats 43 on locking flange 44 to prevent the locking member 40 from being rotated when the locking flange is in the vertical locked position and fully assembled to mounting tang 31 on bolt handle 30. In addition, in configurations where the mounting tang 31 may have curved, rounded, or chamfered lateral edges formed between the top, bottom, and front/rear sides as shown in FIG. 4, the recessed seats provide a flat surface for abutting and engaging the mating flat surfaces on the rear facing side of the locking flange 44 when in the vertical locked position. In other suitable embodiments contemplated, recessed seats 36 may be omitted and substantially planar portions of front side 34*a* of mounting tang 31 disposed adjacent locking aperture 33 may instead define forward facing seats 36.

Referring to FIGS. 6-8 and 10, the bolt assembly further includes a cocking piece 100 which is mounted onto the rear end 56 of striker 50. Cocking piece 100 is engaged by the trigger-sear assembly 11 in a conventional manner for holding the spring-loaded striker 50 in a rearward and ready-to-fire position. Operation of the trigger releases the cocking piece 100 and concomitantly striker 50 moves forward to contact a chambered round and discharge rifle 10.

With continuing reference to FIGS. 6-8 and 10, cocking piece 100 in some embodiments may include a forked front having a pair of laterally spaced apart and forward axially projecting tines 102, a rearward axially projecting protrusion 104, and a laterally projecting protrusion 108 for drawing the firing pin striker 50 rearward. Tines 102 alternatingly engage and disengage camming notches 110 (see FIG. 6) on the rear end of the breech bolt 20 when the bolt is rotated via bolt handle 30. It will be appreciated that the cocking piece 100 remains rotationally stationary with respect to the receiver 14 and firing pin striker 50 when mounted to rifle 10 as the bolt 20 is rotated in a conventional manner. This is facilitated by protrusion 108 which engages a notch in the receiver 14 (not shown) which prevents the cocking piece 100 from rotating. Protrusion 108 also limits the insertion depth of the rear end 56 of the striker 50 into the cocking piece through an axially extending mounting hole 106. In some embodiments, as shown, hole 106 extends completely through the cocking piece (best shown in FIG. 10).

Cocking piece 100 may be mounted onto striker 50 by any suitable method commonly used in the art including threading, shrink or press fit, etc. In one embodiment, as best shown in FIG. 6, mounting hole 106 may be threaded and cocking piece 100 threads onto complementary configured threads disposed on rear end 56 of striker 50 as best shown in FIG. 6.

An exemplary method of mounting the bolt handle 30 to bolt 20 of rifle 10 will now be described. In some embodiments, the locking member 40 and cocking piece 100 may first be mounted onto firing pin striker 50 before the striker is inserted into bolt 20.

FIGS. 4 and 6 shows the bolt handle 30, locking member 40, and cocking piece 100 in an unassembled state. In one embodiment, the firing pin striker 50 may be assembled first by initially sliding the firing pin spring 52 onto the rear end 56 of the striker 50, followed by sliding locking member 40 onto the rear end of the striker and axially forward. Locking flange 44 serves as a firing pin spring stop (see FIGS. 7 and 8). Cocking piece 100 may next be mounted onto rear end 56 of striker 50. In one embodiment, cocking piece 100 may be threaded onto the striker where a threaded connection is used as described herein. The components collectively define a firing pin striker assembly, which in a preferred bolt handle mounting method has not been inserted into bolt 20 as of yet.

The bolt assembly method continues by first laterally aligning and then inserting mounting tang 31 of bolt handle 30 completely through handle-receiving slot 21 in bolt 20. When fully seated, as shown in FIG. 5, elongated aperture 33 is axially aligned with channel 28 in bolt 20. Preferably, bolt handle 30 is inserted into bolt 20 before the foregoing firing pin striker 50 assembly (i.e. striker 50, spring 52, locking member 40, and cocking piece 100) otherwise the striker would interfere with insertion of mounting tang 31 through slot 21 in bolt 20.

Next, the firing pin striker 50 assembly is axially aligned with channel 28 in bolt 20. The locking member 40 is rotated and adjusted in position until locking flange 44 is horizontally oriented and positioned as shown in FIG. 4 with ears 44*a*, 44*b* projecting laterally or sideways. The rear flange 42 is oriented vertically as shown. In this pre-insertion position, the locking flange 44 is oriented so that each of the ears 44*a*, 44*b* are axially aligned with corresponding portions of locking aperture 33 in mounting tang 31 of the bolt handle 30, as shown in FIG. 4. This allows the front end 47 of locking member 40 to be inserted completely through locking aperture 33 as described below since when the locking flange is oriented vertically, the ears 44*a*, 44*b* would engage portions of the locking aperture 33 immediately above and below the locking aperture which would prevent insertion or withdrawal of the locking member into or from the aperture.

Next, the firing pin striker 50 assembly is slidably and axially inserted in a forward direction through the open rear end 26 of bolt 20 into the rear portion of channel 28, preferably with spring 52 already positioned on the striker. The horizontal and vertical orientation of locking flange 44 and rear flange 42, respectively as described above is preferably maintained during this insertion step. The striker 50 is fully inserted until locking flange 44 enters and passes forward completely through elongated aperture 33 in bolt handle 30. Locking flange 44 is preferably positioned in front of front side 34*a* on bolt handle mounting tang 31. Locking flange 44 would still be in the horizontal position shown in FIG. 4 so that ears 44*a*, 44*b* are axially aligned with locking aperture 33. This will be referred to for convenience as the unlocked position of the locking flange 44. The diametrically smaller cylindrical intermediate portion 46 of locking member 40 is located within elongated aperture 33 in mounting tang 31 and positioned in the middle of the aperture. The locking member 40 (and striker 50 to which it is attached) will slide forward until a front flat face 45 defined by diametrically enlarged cylindrical boss portion 48 abuts rear side 34*a* on the mounting tang 31. This prevents the cocking piece 100 and striker 50 from being moved further forward. The axial length of the intermediate portion 46 is preferably selected so that when the abutment occurs, the locking flange 44 will be in the desired positions described above just forward of mounting tang 31 and elongated aperture 33 in bolt handle 30.

With the striker 50 and locking member 40 in the position described immediately above, the locking member is next rotated 90 degrees in a clockwise direction (viewing the assembly from front end 24 of bolt 20 towards the rear with reference to FIG. 4). The locking flange 44 concomitantly rotates 90 degrees in the same direction so that the locking flange is now oriented and positioned vertically as shown in FIG. 5. This will be referred to as the locked position of locking flange 44. The rear facing flat side of locking flange 44 on ears 44*a*, 44*b* are seated on (i.e. engages and abuts) the mating front facing flat surfaces in recessed seats 36. Accordingly, a portion of locking flange 44 in this rotated position is now located above and below locking aperture 33 as shown so that rearward withdrawal of locking member 40 is blocked. The bolt handle 30 is locked to the bolt 20 and cannot be removed from slot 21 (see also FIGS. 7-8). The rear end of spring 52 abuts the locking flange 44, which slightly axially displaces and biases this flange rearward against front side 34*a* (e.g. recessed seats 36) on mounting tang 44 to assist with maintaining the locking flange in vertical locked position. The flat vertical sidewalls 36*a* defined by recessed seats 36 help prevent the cocking piece 100 from being rotated once the locking flange 44 is fully assembled to mounting tang 31 on bolt handle 30 and locked in position.

It will also be noted that rotating locking flange 44 to the locked position shown in FIG. 5 concomitantly rotates the rear flange 42 clockwise by 90 degrees.

To rotate the locking flange 44 counterclockwise back to unlocked horizontal position (see FIG. 4), the cocking piece 100 must be pushed slightly forward axially to move the flange off recessed seats 36 and forward beyond the vertical sidewalls 36*a* in the seats.

Advantageously, the embodiments of the present disclosure as described herein provide a system and method for releasably attaching the bolt handle to the bolt without the use of mechanical fasteners, threading, welding/soldering, or machining the handle integrally with the bolt. This results in convenience and manufacturing savings.

Bolt 20, bolt handle 30, firing pin striker 50, locking member 40, bolt shroud 200, cocking piece 100, and other components described herein may be made of any suitable materials commonly used for such components, including without limitation steel, aluminum, titanium, other metals and alloys, and non-metals including polymers and composite materials.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A bolt handle assembly for a rifle comprising:

a bolt having an elongated body defining a longitudinal axis, an internal channel extending between forward and rear ends of the bolt, and a laterally extending slot;

a bolt handle including a mounting tang removably inserted through the slot in the bolt and having a locking aperture positioned in the internal channel of the bolt;

a firing pin striker slidably disposed in the internal channel of the bolt;

a locking member mounted on the firing pin striker, the locking member having a portion with front end configured and dimensioned for axial insertion through the locking aperture of the bolt handle, the locking member being rotatable and operable to engage the mounting tang of the bolt to releasably secure the bolt handle to the bolt; and wherein the front end of the locking member comprises a locking flange including at least one radially extending ear that is engageable with the mounting tang of the bolt handle.

2. The bolt handle assembly of claim 1, wherein the locking member is rotatable between:

a locked position in which the front end of the locking member engages the mounting tang of the bolt handle and the locking member cannot be moved axially in the bolt; and an unlocked position in which the front end of the locking member disengages the mounting tang of the bolt handle and the locking member can be moved axially in the bolt.

3. The bolt handle assembly of claim 2, wherein when the locking member is in the unlocked position, the front end of the locking member is configured and oriented so that the front end can be axially withdrawn rearwards through the locking aperture of the bolt handle.

4. The bolt handle assembly of claim 2, wherein when the locking member is in the locked position, the front end of the locking member is configured and oriented so that the front end cannot be axially withdrawn rearwards through the locking aperture of the bolt handle.

5. The bolt handle assembly of claim 1, wherein the at least one radially extending ear of the locking flange engages a recessed seat on the mounting tang of the bolt handle.

6. The bolt handle assembly of claim 1, wherein the front end of the locking member has a T-shape configuration and the locking aperture of the mounting tang of the bolt handle has a laterally elongated configuration to insertably receive the front end of the locking member.

7. The bolt handle assembly of claim 6, wherein the locking aperture has a greater width than height, and the locking flange has a greater width than height.

8. The bolt handle assembly of claim 1, wherein the locking flange is rotatable with respect to the mounting tang of the bolt handle for locking the locking member to the mounting tang of the bolt handle.

9. The bolt handle assembly of claim 1, further comprising a cocking piece disposed on the rear portion of the firing pin striker rearward of the locking member.

10. The bolt handle assembly of claim 1, wherein the front end of the locking member comprises a pair of radially extending ears that are rotatably engageable with mounting tang of the bolt handle.

11. The bolt handle assembly of claim 1, wherein the locking member has a generally cylindrical body including a diametrically enlarged boss engaging a rear side of the mounting tang of the bolt handle anti the front end of the locking member has a locking flange engaging a front side of the mounting tang.

12. The bolt handle assembly of claim 1, wherein the locking member is rotatably disposed in a rear portion of the internal channel of the bolt and moveable between locking and unlocking positions with respect to the mounting tang of the bolt handle.

13. A bolt handle assembly for a rifle comprising:

a bolt having an elongated body defining a longitudinal axis, an internal channel extending between forward and rear ends of the bolt, and a laterally extending slot;

a bolt handle including a mounting tang removably inserted through the slot in the bolt and having a locking aperture positioned in the internal channel of the bolt, the bolt handle having a front side and a rear side;

a firing pin striker slidably disposed in the internal channel of the bolt; and a locking member having a generally cylindrical body configured and dimensioned for at least partial insertion into the internal channel of the bolt, the locking member rotatably disposed in the internal channel of the bolt, the locking member including a locking flange engageable with the mounting tang of the bolt handle, the locking flange configured for longitudinal axial insertion through the locking aperture of the bolt handle;

wherein the locking flange is operable to lock the bolt handle to the bolt when the locking member is in a first locked rotational position;

wherein the locking flange is operable to unlock the bolt handle from the bolt for removal when the locking member is in a second unlocked rotational position; and wherein the locking flange includes at least one radially extending ear that engages the front side of the mounting tang of the bolt handle when the locking member is in the locked position.

14. The bolt handle assembly of claim 13, wherein the locking flange includes at least one radially extending ear that is aligned with the locking aperture in the mounting tang of the bolt handle when the locking member is in the unlocked position so that the locking flange can be axially moved through the aperture.

15. The bolt handle assembly of claim 13, wherein the locking flange is a T-shaped portion on a front end of the locking member.

16. The bolt handle assembly of claim 13, wherein the locking flange of the locking member and the locking aperture of the bolt handle are complementary configured so that the locking flange is axially insertable through the locking aperture when the locking member is in the second unlocked rotational position, and the locking flange is not axially insertable through the locking aperture when the locking member is in the first locked rotational position.

17. The bolt handle assembly of claim 13, wherein the locking member includes a diametrically enlarged boss that engages a rear side of the mounting tang of the bolt handle and the locking flange of the locking member engages a front side of the mounting tang when the locking member is in the first locked rotational position.

18. A bolt handle assembly for a rifle comprising:

a bolt having an elongated body defining a longitudinal axis, an internal channel extending between forward and rear ends of the bolt, and a laterally extending slot;

a bolt handle including a mounting tang removably inserted through the slot in the bolt and having a locking aperture positioned in the internal channel of the bolt, the mounting tang having a front side and a rear side;

a firing pin striker slidably disposed in the internal channel of the bolt;

a locking member rotatably disposed in the internal channel of the bolt and mounted on the firing pin striker, the locking member including at least one rear facing abutment surface rotatable into and out of engagement with a forward facing seat on the front side of the mounting tang of the bolt handle, the at least one rear facing abutment surface being operable to lock the bolt handle to the bolt; and wherein the locking member includes at least one radially extending ear that engages the front side of the mounting tang of the bolt handle when the locking member is in the locked position.

19. The bolt handle assembly of claim 18, wherein the at least one rear facing abutment surface is rotatable into axial alignment with the locking aperture of the bolt handle for disengaging the at least one rear facing abutment surface from the mounting tang of the bolt handle.

20. The bolt handle assembly of claim 19, wherein the at least one rear facing abutment surface is disposed on a front end portion of the locking member axially inserted through the locking aperture of the bolt handle, the front end portion of the locking member being axially removable in a rearward direction through the locking aperture of the bolt handle when the at least one rear facing abutment surface is in axial alignment with the locking aperture.

21. The bolt handle assembly of claim 20, wherein the front end portion of the locking, member is blocked from being axially removable when the at least one rear facing abutment surface is engaged with the forward facing seat on the front side of the mounting tang of the bolt handle.

22. A method for mounting a bolt handle to a bolt action rifle comprising:

providing a bolt having an elongated body defining a longitudinal axis, an internal channel extending between forward and rear ends of the bolt configured for receiving a firing pin striker, and a laterally extending slot;

laterally inserting a mounting tang of a bolt handle having a locking aperture through the slot in the bolt;

axially inserting an end of a locking member through the locking aperture in a first longitudinal direction;

rotating the locking member in a first direction;

engaging the end of the locking member with the mounting tang of the bolt handle, wherein the bolt handle cannot be removed from the bolt; and wherein the end of the locking member includes at least one radially extending ear that engages a front side of the mounting tang of the bolt handle during the engaging step.

23. The method of claim 22, wherein the axially inserting step includes positioning the locking aperture of the bolt handle in the internal channel of the bolt.

24. The method of claim 22, wherein the end of the locking member is inserted forward through the internal cavity of the bolt from a rear side of the mounting tang through the locking aperture.

25. The method of claim 22, wherein the end of the locking member is T-shaped.

26. The method of claim 25, wherein the T-shape is defined on a radially extending locking flange having a pair of opposing ears configured to engage the mounting tang of the bolt handle and the locking aperture of the bolt handle is laterally elongated in shape having a complementary configuration to the locking flange.

27. The method of claim 22, further comprising:

rotating the locking member in a second direction;

disengaging the end of the locking member from the mounting tang of the bolt handle; and axially withdrawing the end of a locking member through the locking aperture in a second longitudinal direction, wherein the bolt handle can be removed from the bolt.

* * * * *